US005382750A

United States Patent [19]

Masahiko et al.

[11] Patent Number: 5,382,750

[45] Date of Patent: Jan. 17, 1995

[54] ELECTRONIC MUSICAL INSTRUMENT WITH AN AUTOMATIC PLAYING FUNCTION

[75] Inventors: Hasebe Masahiko; Yasushi Kurakake, both of Hamamatsu, Japan

[73] Assignee: Yamaha Corporation, Hamamatsu, Japan

[21] Appl. No.: 996,702

[22] Filed: Dec. 24, 1992

[30] Foreign Application Priority Data

Dec. 26, 1991 [JP] Japan ..... 3-344918

[51] Int. Cl.[6] ..... G10H 1/42

[52] U.S. Cl. ..... 84/636; 84/DIG. 12

[58] Field of Search ..... 84/612, 636, 652, 668, 84/DIG. 12

[56] References Cited

U.S. PATENT DOCUMENTS 4,033,220 7/1977 Shibahara ..... 84/668 X
4,354,412 10/1982 Deutsch ..... 84/636
4,476,764 10/1984 Nishimoto ..... 84/DIG. 12
4,478,123 10/1984 Hosheii ..... 84/DIG. 12
5,220,120 6/1993 Mukaino ..... 84/636

FOREIGN PATENT DOCUMENTS 57-8590 1/1982 Japan .

*Primary Examiner*—Stanley J. Witkowski
*Attorney, Agent, or Firm*—Spensley Horn Jubas & Lubitz

[57] ABSTRACT

An electronic musical instrument has an automatic playing device which conducts an automatic musical performance at a tempo set by manually tapping of a pad before the beginning of the performance. The automatic playing device also starts the automatic performance based on the detection that the number of the tapping has coincided with the predetermined number. The tempo is set according to an interval between the successive tapping. The successive taps can be the latter two taps when the tapping is made for a number of time of music. Also, the electronic musical instrument is equipped with a tap voice output device that outputs counting voices, such as 'one', 'two', 'three', for each tapping.

18 Claims, 10 Drawing Sheets

ELECTRONIC MUSICAL INSTRUMENT WITH AN AUTOMATIC PLAYING FUNCTION

BACKGROUND OF THE INVENTION

1. Field of the Invention

The present invention relates to an electronic musical instrument that is capable of automatically musical playing with a tempo designated by a player, and more particularly to an improvement of a tempo designation method and a beginning method of the musical playing of the instrument.

2. Description of the Prior Art

Electronic musical instruments having an automatic musical playing function have been in practical use. These instruments can generally start the automatic musical playing by putting a start switch on. Normally, the tempo in the automatic playing mode is designated by having a numeral representing the tempo displayed on such a display as an LCD display or the like, and the tempo can be changed beforehand to any desired value by an operation of a tempo switch and so on.

The above mentioned manner of the tempo setting is a manner in which the tempo is set by a sign of a metronome (i.e., a sign representing how many notes a quarter note counts in one bar), and therefore it is difficult for a person who is not familiar with music to set precisely the tempo of his intention. While, an electronic metronome that is capable of setting a tempo by an operation of a player's tapping is disclosed in Japanese Utility Model Laid-open application No. sho 57-8590. It is, however, not an automatic musical playing instrument, so that it doesn't have functions that the automatic musical playing is started with the tempo set by the player's tapping operation, and that the automatic musical playing is started simultaneously with the setting of the tempo.

SUMMARY OF THE INVENTION

It is therefore an object of the present invention to provide an electronic musical instrument which is capable of starting automatic musical playing with a tempo set by the player's tapping.

It is another object of the present invention to provide an electronic musical instrument which is capable of setting the tempo based on the tapping manner of the player.

In accordance with an embodiment of the present invention, an electronic musical instrument with an automatic playing function comprising storage means for storing a plurality of automatic playing pattern data and a number of time of each of the automatic playing data, selection means for selecting automatic playing pattern data to be played from the storage means, playing manipulation means, decision means for starting automatic playing when the playing manipulation means is manipulated the same times as a number of meter of the automatic playing pattern data selected by the selection means and deciding a tempo according to an interval between the manipulations of the playing manipulation means, and automatic playing means for reading the automatic playing pattern data selected by the selection means from the storage means and automatically playing according to the automatic playing data at the tempo decided by the decision means.

According to the electronic musical instrument, the tempo is decided based on the interval between the manipulations when the playing manipulation means is manipulated the same times as the number of meter (time) of the automatic playing pattern data. After the tempo is decided, the automatic musical playing is started at the decided tempo.

DETAILED DESCRIPTION OF THE PREFERRED EMBODIMENTS

Figure 1:
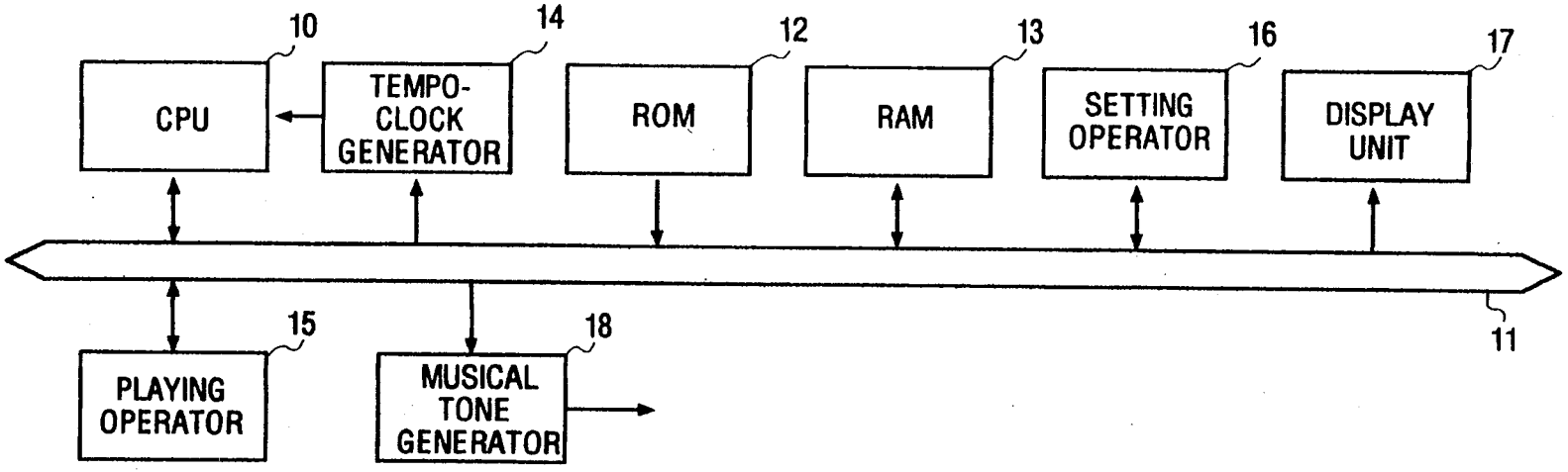
FIG. 1 is a block diagram of an electronic musical instrument embodying the present invention.
Figure 2:
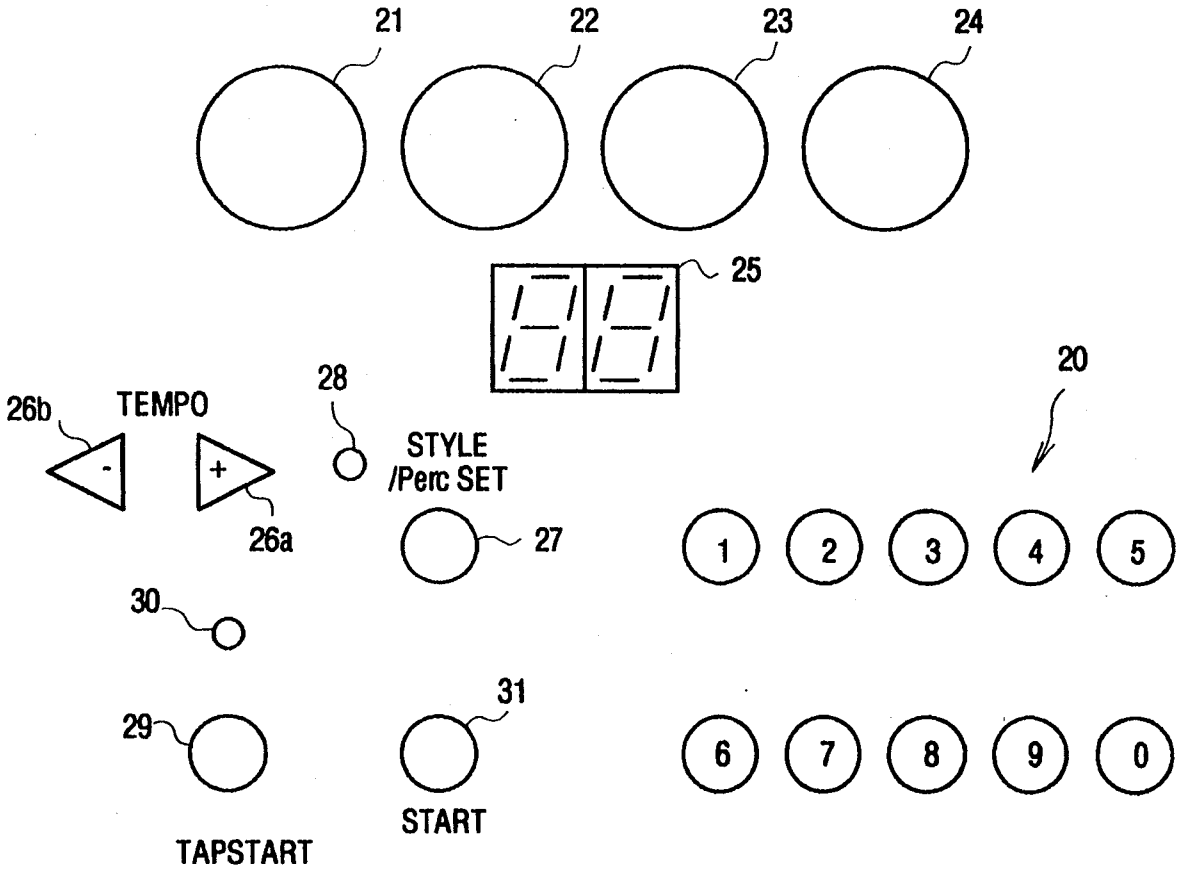
FIG. 2 is a schematic operation panel of the electronic musical instrument.

FIG. 1 is a block diagram of an electronic musical instrument (rhythm machine) embodying the present invention. The rhythm machine is controlled by a CPU 10. The CPU 10 is connected to a ROM 11, a RAM 13, a tempo clock generator 14, a playing operator 15, a setting operator 16, a display unit 17 and a musical tone generation part 18 through a buss 11. The ROM 12 stores a program for control of the electronic musical instrument, tone color data and so on. The RAM 13 has various registers for the control. The tempo clock generation part 14 is a clock generator for forming clock pulses at a cycle of a period that is one forty-eighth of a quarter note period which is designated by the CPU 10. The clock pulse is inputted into an interruption terminal of the CPU 10. The CPU 10 performs an automatic musical playing process synchronized with the clock pulse. The playing operator 15 is provided with four pads 21 to 24 as shown in FIG. 2. A different tone color is assigned to each pad. The setting operator 16 includes a ten-key 20, a tempo switch 26 (26*a*, 26*b*), a mode setting switch 27, a tap start switch 29 and a start/stop switch 31. The display unit 17 includes a 2-rows 7-segmented display 25 and an LED indicators 28 and 30. The musical tone generation part 18 generates a specified musical tone signal according to tone color data and musical playing data inputted from the CPU 10.

FIG. 2 shows a schematic arrangement of an operation panel. Pads 21 to 24 is formed as large as a player can play with his palm or fingers, and arranged horizontally in one line. The ten-key 20 is used for selecting a tone color of each pad or a rhythm style. The tempo switch 26 (26*a*, 26*b*) is a switch for manually setting or changing a tempo of the automatic playing. The switch 26*a*'s on causes a tempo-up of a specified amount, while the switch 26*b*'s on causes a tempo-down of a specified amount. The mode setting switch 27 is a switch for defining the inputted number from the ten-key 20 as a rhythm style number or a percussion tone color number. It is possible to designate the tone color by the pads 21 to 24. It is also possible to designate a combination of the four tone colors by use of the pads 21 to 24.

The tap start switch 29 is a switch for entering a specified mode (tap start mode) that the automatic playing is started when each of the pads 21 to 24 is operated (turned on) for one bar (e.g., four-time operations in quarter time music, three-time operations in simple triple time music). In this mode, when four taps are made, the automatic playing is started from the first beat of the next bar in the quarter time music, for example. The tempo of the case is decided so that the period between the latter two beats (the second beat and the third beat) out of the four beats tapped on is one beat.

The start/stop switch 31 is a switch for making the automatic playing start or stop. When the switch 31 is turned on in a normal mode, the automatic playing is started immediately. While, when the switch 31 is turned on in the automatic playing mode, the automatic playing is ended at the first met beat after the switch-on. In case that the automatic playing is started by the start/stop switch 31, the tempo becomes a tempo set by the tempo switch 26.

Figure 3:
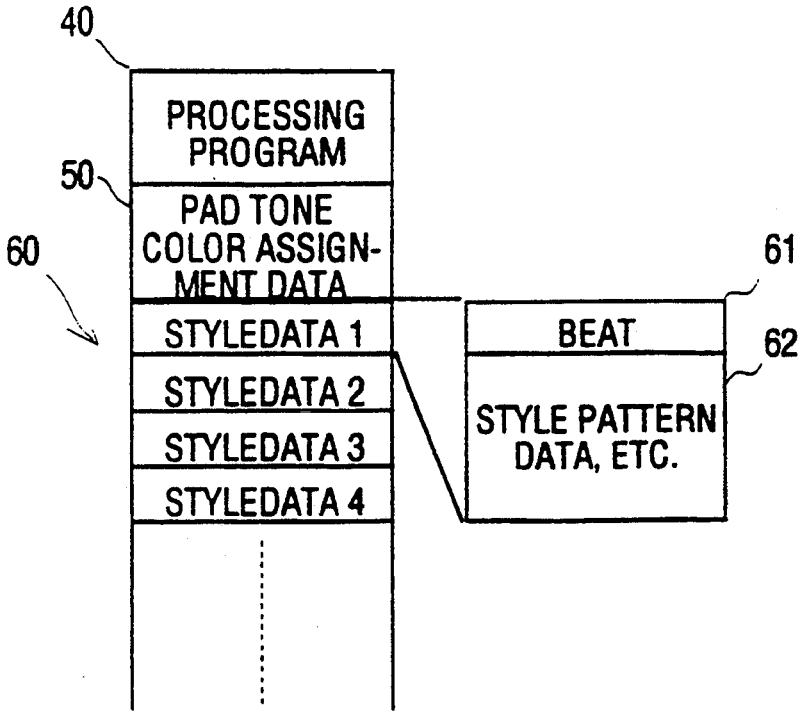
FIGS. 3(A)–3(B) shows a_part arrangement of a ROM in the electronic musical instrument.
Figure 3:
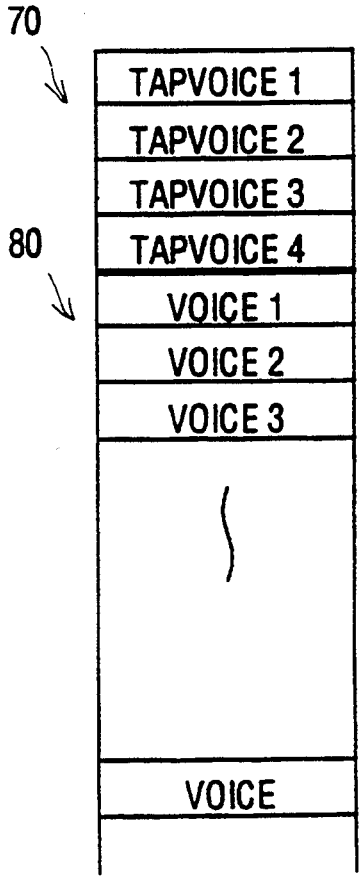

FIG. 3 shows a part configuration of the ROM 12. In the FIG. (A), an area 40 is a process program storage area.In this area, the program stated later as a flow chart is stored. The area 50 is a pad-tone-color-assignment-data storage area. In this area, a plurality of combinations of the tone color numbers, each tone color number is different and assigned to each of the pads 21 to 24, are stored. The combination of the tone color number is designated by the ten-key. An area 60 is a style data storage area that stores a plurality of style data. The style data is automatic playing data. Beat number data BEAT 61 is located at the head of each of the style data. In FIG. 3 (B), an area 70 is a tap voice storage area. The tap voice data is voice counting data generating counting voice, such as 'one, two, three, four', which is generated when any pad is operated for one bar. The player operates (taps) the pads in synchronization with the tap voice data before the automatic playing in the tap start mode. An area 80 is a percussion tone color data storage area in which a plurality of tone color data of percussion. The selected percussion tone color data is read from this area to send it to the musical tone generation part 18.

Figure 4:
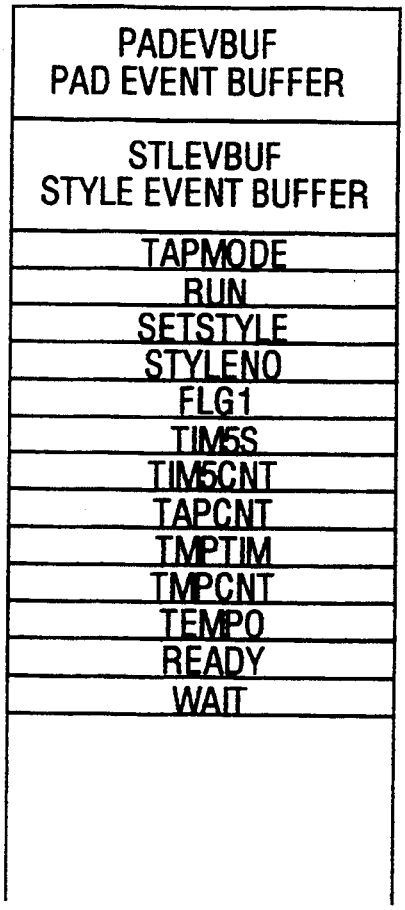
FIG. 4 shows a part arrangement of a RAM in the electronic musical instrument.

FIG. 4 shows registers set in the RAM 13. The function of each register will be descried later together with the description of the process.

FIGS. 5 to 11 are flow charts showing the process of the above mentioned electronic musical instrument.

Figure 5:
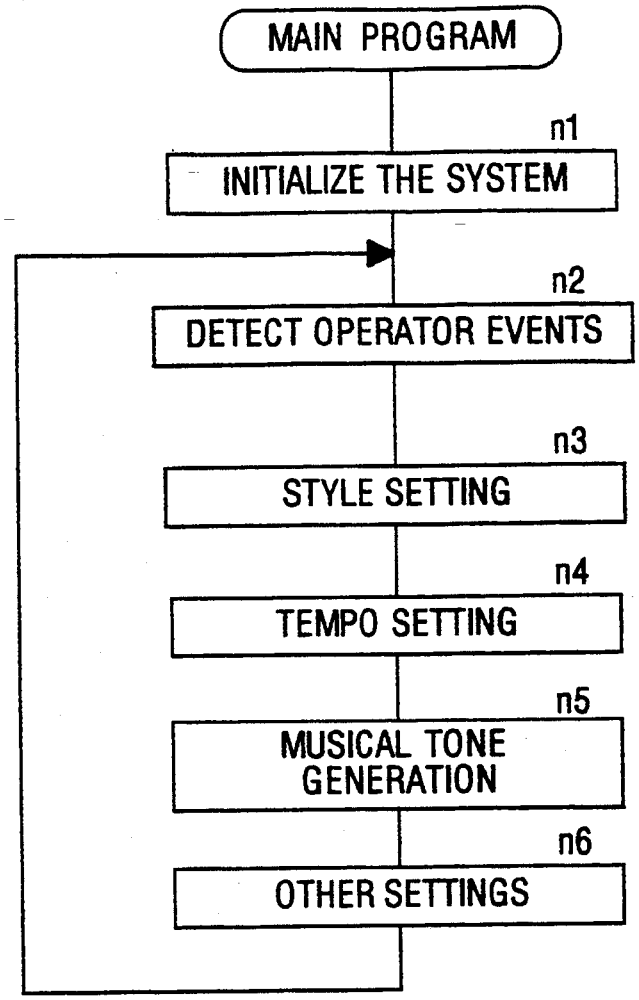
FIGS. 5 to 11 are flow charts showing a process of the electronic musical instrument.

FIG. 5 is a main program. When a power switch is turned on, a system initialization process is performed (n1). After that, a detecting process of an operator event (n2), a style setting process (n3), a tempo setting process (n4), a musical tone generation and playing process (n5) and other processes (n6) are performed. The detecting process of the operator event (n2) includes a detecting process of any switch on/off event of pads 21 to 24 and panel switches to write the event data into a pad event buffer PADEVBUF and a style event buffer STLEVBUF, and a mode changing process for changing a mode to the corresponding mode to the switch-on event of a mode setting switch 27 or a tap start switch 29, and an on-off process of LEDs 28 and 30.

Figure 6:
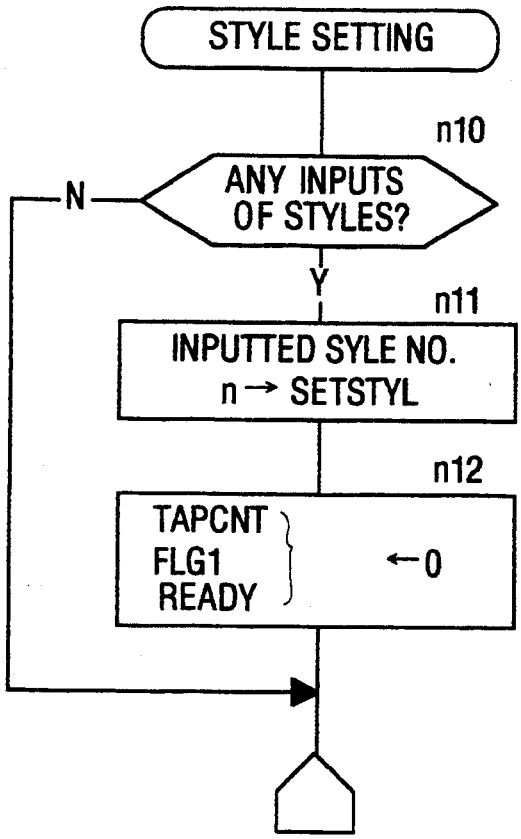

FIG. 6 is a flow chart showing the style setting process. At n10, whether any style-input-event occurs or not is judged. The style event occurs when the ten-key is operated after the style setting mode is set by an operation of the mode setting switch 27. No style-input-event makes the process return. If any style-input-event occurs, the style number n inputted from the ten-key 20 is set into a register SETSTYL (n11). After that, registers of TAPCNT, FLG1 and READY for the tap start mode are initialized (n12). Since the registers for the tap start mode are initialized, if the rhythm style is changed in the tap start mode, the tap start mode is kept, but the process of the mode is initialized by n12.

Figure 7:
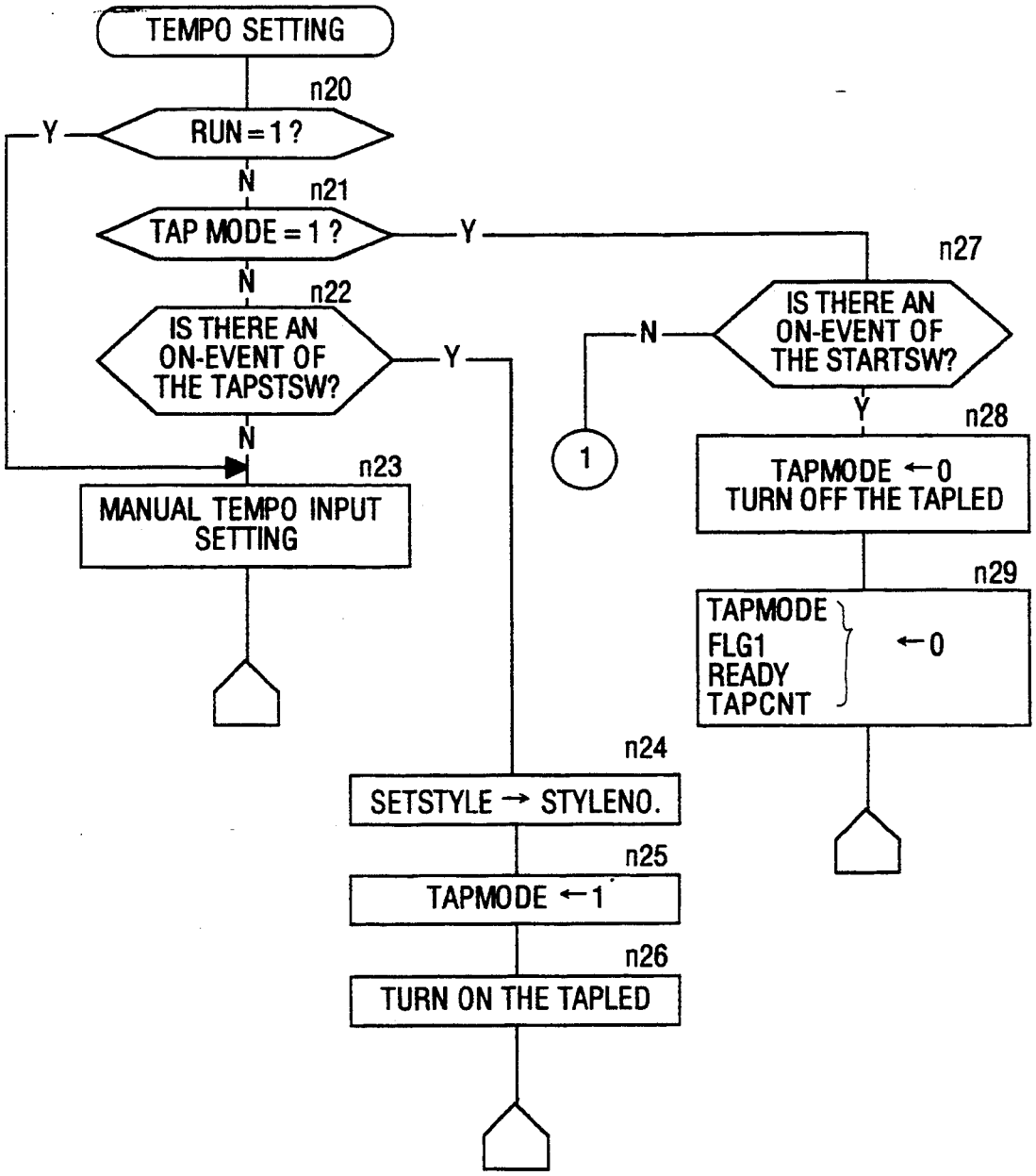
Figure 8:
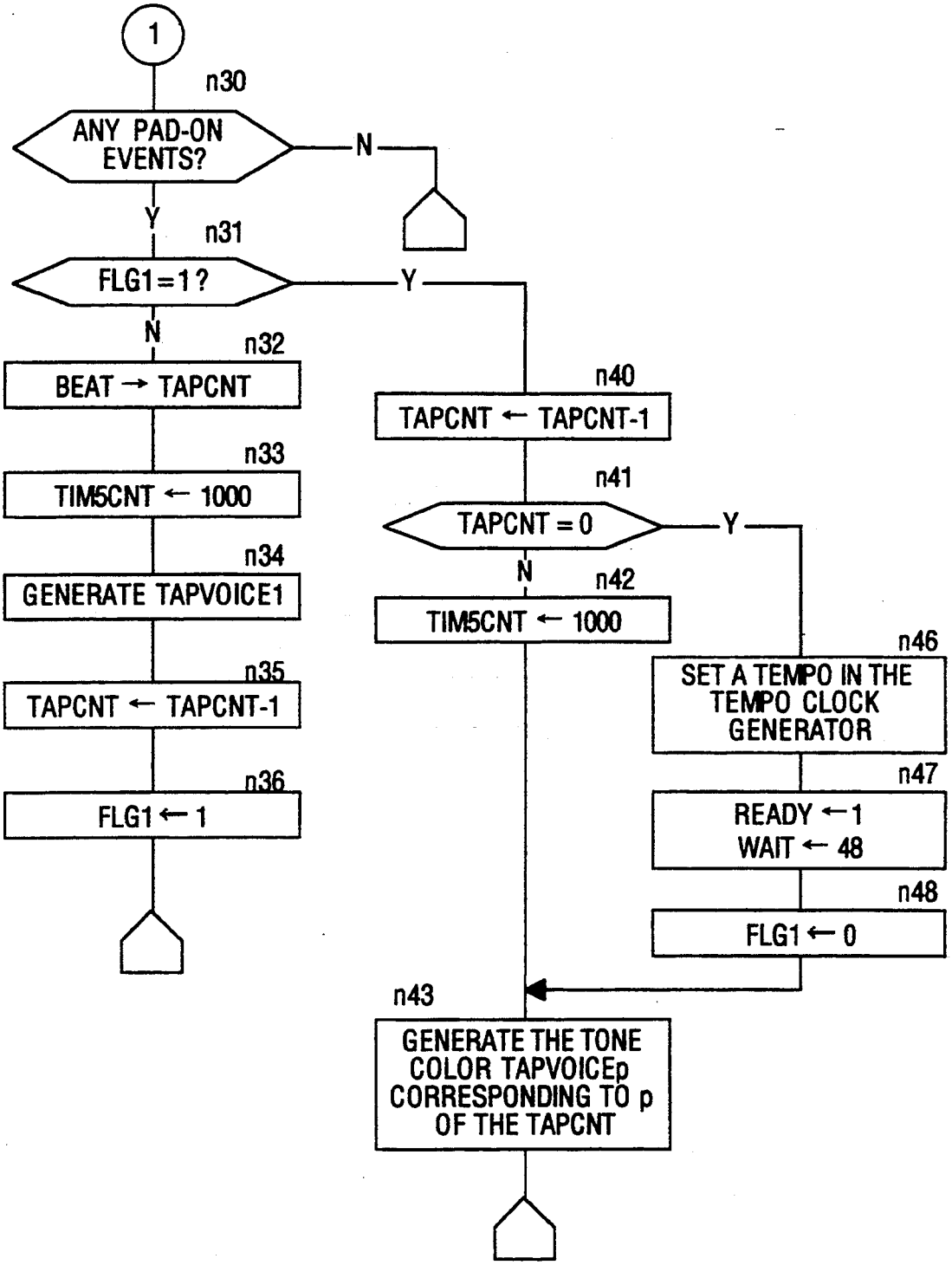

FIGS. 7 and 8 are flowcharts showing the tempo setting process. First, the register RUN is judged (n20). If RUN=1, it means that the present mode is the automatic playing mode, so that the process directly goes to a manual tempo inputting process (n23) since the start process is not required. If RUN=0, a tap mode flag TAPMODE is judged (n21). The flag is set in the tap start mode. If the TAPMODE=1, the process goes to n27 since the present mode is in the tap start mode. If the TAPMODE=0, it is judged whether any on event of the tap start switch 29 occurs or not (n22). If the on event occurs, the tap start mode is set (n24 to n26). The tap start mode setting process includes a setting process for setting the SETSTYLE into the STYLENO (style number register for the playing) (n24), a setting process for setting the TAPMODE representing the tap start mode (n25), and a turning on process of the LED 30 (n26). No on-event of the tap start switch 29 causes the process moving to n23 at which the set tempo value goes up and down according to the on event of the tempo switch 26.

If the TAPMODE=1 to cause the process to go to n27, it is judged whether any on event of the start switch 31 occurs or not (n27). If an on event of the start switch occurs, the present state represents the automatic playing start in the normal mode. Therefore, the tap start process is stopped by setting 0 into the TAPMODE and the LED 30 is turned off (n28). Furthermore, the various registers for the tap start mode, TAPMODE, FLG1, READY, and TAPCNT, are cleared (n29).

If any pad on event occurs in the tap start mode, it is judged whether the FLG1 represents 1 or not (n30, n31). The FLG1 is a flag which indicates that the present time is in the tapping period that starts from the beginning of music. If the FLG1=0, this means that the present pad-on occurs at the first beat, so that the presently selected rhythm style's beat BEAT (see the numeral 61 in FIG. 3) is set in the tap number counter TAPCNT (n32). Next, the FLG1 is set (n33), and then the value 1000 is set into a five-second counting timer TIM5CNT for judging the tapping stop timing (n34). The timer interruption is carried out for every five milliseconds, so that 1000 counting causes five seconds elapsing. After that, the TAPCNT for counting the rest of the beats in the present bar is decreased by 1 (n35), and the voice representing the first beat, such as 'one', is synthesized and outputted (n36).

At step n31, if the FLG1=1, the TAPCNT is decremented by 1 (n40), and if the TAPCNT<>0, the value 1000 is set into the TIM5CNT (n42). After that, the voice corresponding to the value of the TAPCNT is synthesized (n43), and the process returns. This routine is repeatedly performed until the TAPCNT becomes 0. At step n41, if the TAPCNT=1, a timer interruption process stated later (refer to step n64 in FIG. 10) measures the pad-on operation period between the last two pad-on operations by measuring the period between the TAPCNT=1 and 0. The tempo to be set as the present one is calculated on the basis of the measured period which regards as one beat. That is, the TAPCNT=0 at step n41 represents that the last pad-on operation is ended, so that the tempo TEMPO is calculated by the measured period of the TMPCNT (n46). The counting interval of the TMPCNT is five milliseconds, so that the tempo is calculated by the formula of $60/(5*10^{-3}*TMPCNT)$. After that, the flag READY for representing that the tap starting of the musical playing is ready is set to 1, the value 48 being set into a decrement counter WAIT for waiting for one beat (n47). The value 48 is decided by the resolution of the tempo clock interruption (refer to FIG. 11). Next, the FLG1 is reset since the above mentioned counting is ended (n48), and then the process goes to n43. At step n43, the voice is synthesized so as to recognize the counting advance as descried previously.

Figure 9:
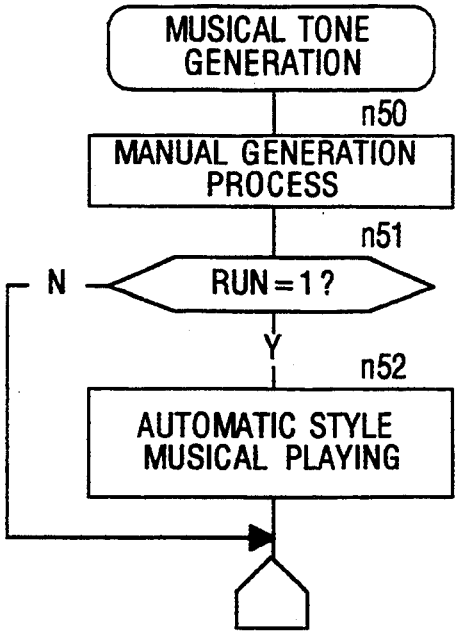

FIG. 9 is a flow chart showing the musical tone generation and playing process. First, the manual musical tone generation process is carried out based on the pad data at n50, and if RUN=1 the automatic style playing process is carried out (n52).

Figure 10:
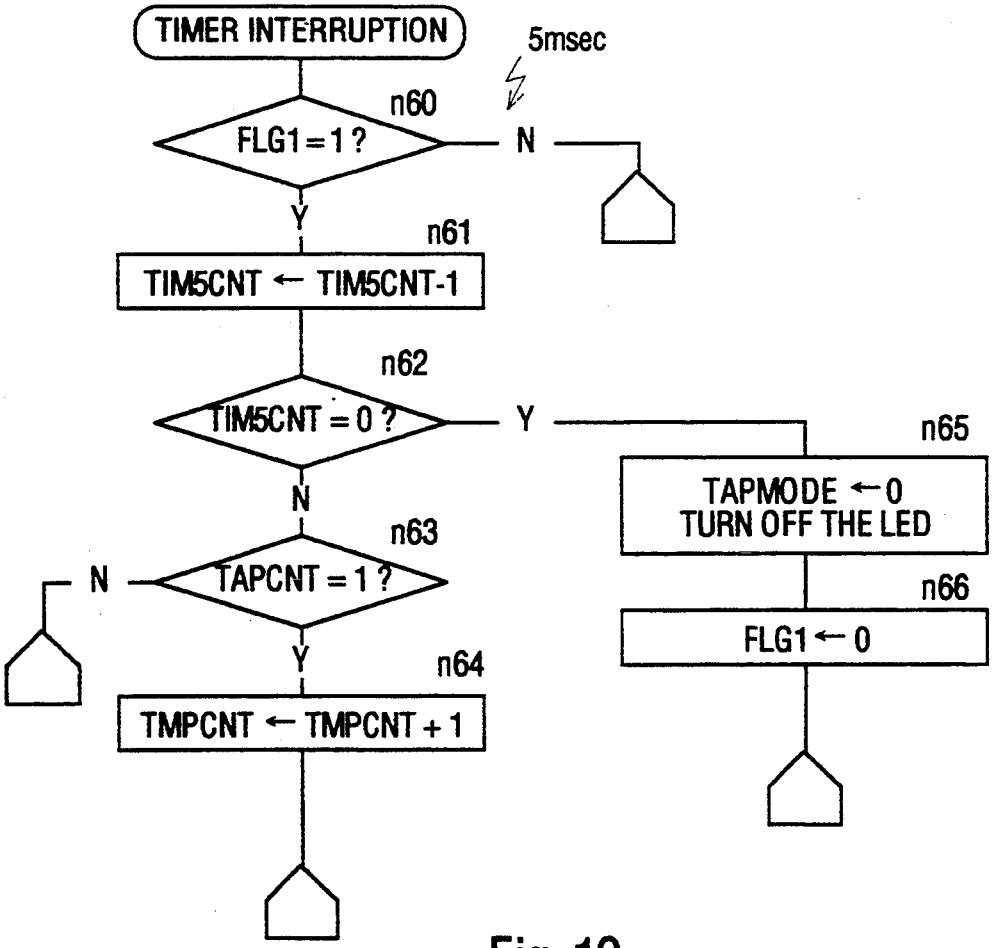

FIG. 10 is a flow chart showing the timer interruption process. The process is performed for every five milliseconds period based on the internal clock of the CPU 10. First, it is judged whether FLG=1 or not (n60). If FLG<>1, the process returns since the tapping is not started in the tap start mode. Otherwise (FLG=1), the five-seconds-interval counting timer TIMSCNT used for judging stop of the tapping (time-up) is decremented by 1 (n61). In the case that the TIMSCNT becomes 0, the process goes to n65 since the present timing should be decided as the tapping stop timing. At step n65, the flag TAPMODE is reset since the tap mode is reset according to the time up, and the LED 30 is turned off (n65). Also, the FLG1 is reset (n66).

If the TIMSCNT>0 at step n62, the TAPCNT is judged at step n63. In case of the TAPCNT=1, the present timing exists between the last two beats (i.e., third beat and forth beat in quarter time music or second beat and third beat in simple triple time music), therefore the tempo counter TMPCNT for measuring the period between the two beats being incremented by 1 (n64) before the return of the process.

Figure 11:
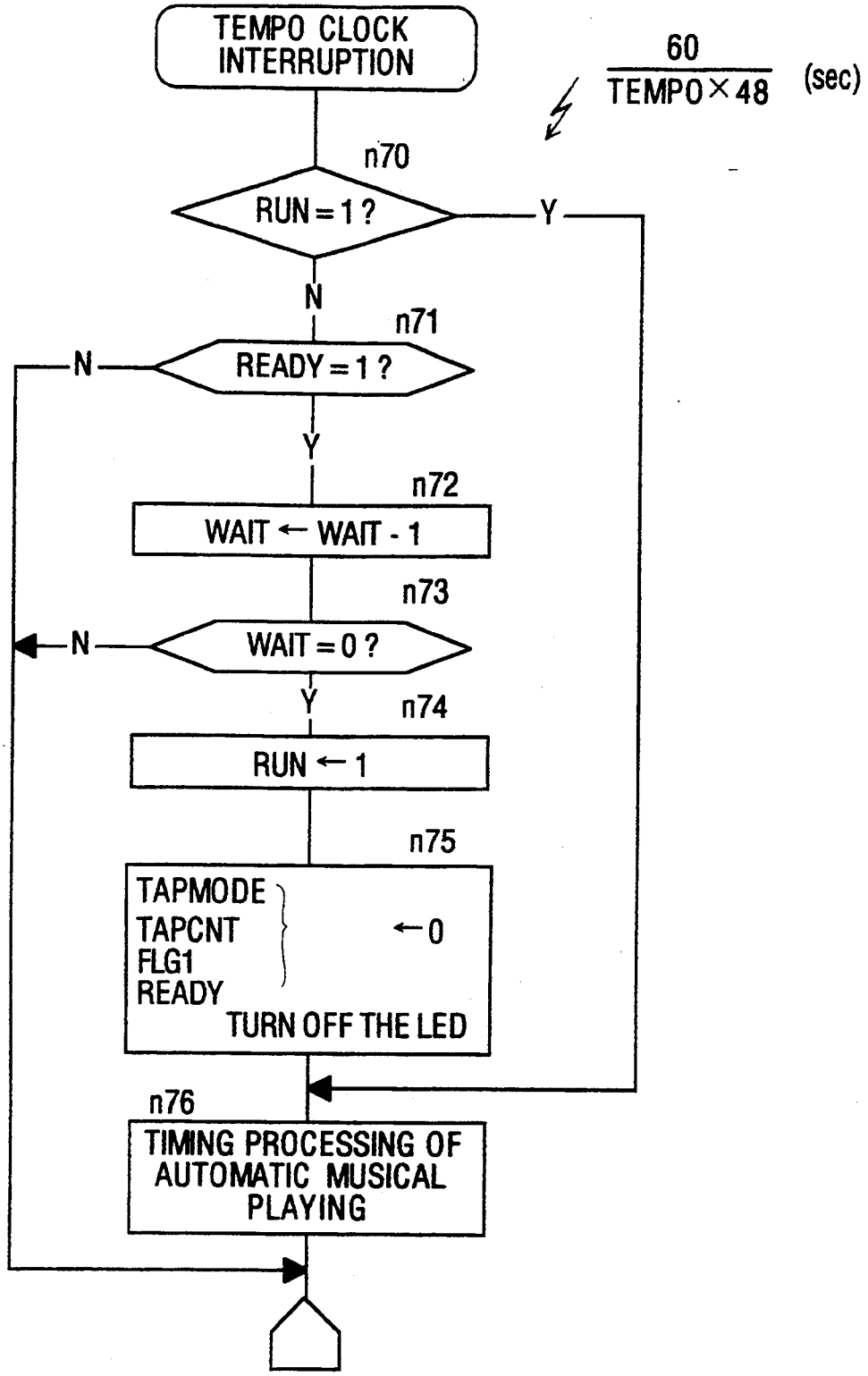

FIG. 11 is a flow chart showing the tempo clock interruption process. The tempo clock generation part 14 is so arranged that the CPU 10 is interrupted for every one forty-eighth of the set tempo TEMPO. This flow is processed by the interruption. First, whether RUN=1 or READY=1 is judged (n70, n72). In case of the RUN=1, the timing process for the automatic playing is carried out (n77), in which the playing data to be generated is set into a register in synchronization with DUR data (duration data). In case of the READY=1, the present state is in that the tapping for one bar is ended in the tapping mode, therefore the automatic playing being started after one beat elapses. To do that, the WAIT set at n48 (tempo setting step in FIG. 8) is decremented by 1 (n73). If the WAIT becomes 0, 1 is set into the RUN, and the registers TAPMODE, TAPCNT, FLG1 and READY that are used for the tap start mode are reset. Also the LED 30 is turned off (n76), and the process goes to n71.

What is claimed is:

1. An electronic musical instrument with an automatic playing function, comprising:

storage means for storing a plurality of automatic playing pattern data and a timing number corresponding to a meter for each of the automatic playing pattern data;

selection means for selecting automatic playing pattern data to be read out from the storage means;

playing manipulation means responsive to manipulations by a player for registering an interval of time between the manipulations and for counting the manipulations;

calculation means for starting automatic playing when the playing manipulation means is manipulated for a number of times corresponding to the timing number for the automatic playing pattern data selected by the selection means and calculating a tempo according to the interval of time between the manipulations of the playing manipulation means prior to starting automatic playing; and automatic playing means for reading the automatic playing pattern data selected by the selection means from the storage means and automatically playing according to the automatic playing pattern data at the tempo calculated by the calculation means.

2. An electronic musical instrument with an automatic playing function according to claim 1, further comprising mode selection means for selecting either a first mode to set the tempo manually or a second mode to set the tempo by the interval of time between the manipulations of the playing manipulation means.

3. An electronic musical instrument with an automatic playing function according to claim 1, wherein the manipulations of the playing manipulation means correspond to a beat, and wherein said automatic playing means starts the automatic playing when one beat elapses after the playing manipulation means is manipulated for a number of times corresponding to the meter of the selected automatic playing pattern data.

4. An electronic musical instrument with an automatic playing function according to claim 1, wherein said calculation means calculates the tempo based on the interval of time between the last two manipulations from among the manipulations of the playing manipulation means corresponding to the meter of the selected automatic playing pattern data.

5. An electronic musical instrument with an automatic playing function according to claim 1, wherein said playing manipulation means is a playing manipulation device of an electronic musical instrument.

6. An electronic musical instrument with an automatic playing function comprising:

storage means for storing automatic playing pattern data;

playing manipulation means responsive to manipulations by a player to register an interval of time between the manipulations;

calculation means responsive to the playing manipulation means for calculating a tempo based on the interval of time between the manipulations of the playing manipulation means prior to starting automatic playing;

tone generation means for generating a specified voice tone relating to a counting for each manipulation of the playing manipulation means; and automatic playing means for reading the automatic playing pattern data from the storage means and automatically playing the automatic playing pattern data at the tempo calculated by the calculation means.

7. An electronic musical instrument with an automatic playing function according to claim 6, wherein said specified voice tone is different for each consecutive manipulation of the playing manipulation means.

8. An electronic musical instrument with an automatic playing function according to claim 6, wherein said tone generation means includes voice tone storage means for storing voice tone data and voice tone reading means for reading the voice tone stored in the voice tone storage means.

9. An electronic musical instrument with an automatic playing function according to claim 7, wherein each specified voice tone corresponds to the number of times that the playing manipulation means is manipulated.

10. An electronic musical instrument with an automatic playing function comprising:

storage means for storing automatic playing pattern data;

playing manipulation means responsive to manipulations by a player for registering an interval of time between the manipulations;

calculation means responsive to the playing manipulation means for calculating a tempo based on an interval of time between the manipulations of the playing manipulation means prior to starting automatic playing;

automatic playing means for starting a reading out of the automatic playing pattern data at the tempo calculated by the calculation means and automatically playing the read out automatic playing data;

measuring means for measuring an elapsed time from the last manipulation of the playing manipulation means; and stop means for preventing the start of the automatic playing if the measuring means measures a elapsed time that equals a specified time.

11. An electronic musical instrument with an automatic playing function, comprising:

a storage device for storing a plurality of automatic playing pattern data and a timing number corresponding to a meter for each of the automatic playing pattern data;

a selection circuit for selecting automatic playing pattern data to be read out from the storage device;

a tempo input device;

a processor circuit for starting automatic playing when the tempo input device is activated for a number of times corresponding with the timing number for the automatic playing pattern data selected by the selection circuit and for calculating a tempo according to an interval of time between activations of the tempo input device prior to starting automatic playing; and an automatic playing circuit for reading out the automatic playing pattern data selected by the selection circuit from the storage device and automatically playing according to the automatic playing pattern data at the tempo decided by the processor circuit.

12. An electronic musical instrument according to claim 11, further including a mode selection switch for selecting between a first mode to set the tempo manually or a second mode to set the tempo by the interval of time between the activations of the tempo input device.

13. An electronic musical instrument according to claim 11, wherein each activation of the tempo input device corresponds to a beat, and wherein the automatic playing circuit starts the automatic playing when one beat elapses after the tempo input device is actuated for a number of times corresponding to the timing number of the selected automatic playing pattern data.

14. An electronic musical instrument according to claim 11, wherein the processor circuit calculates the tempo based on the interval of time between the last two activations from among the activations of the tempo input device that correspond to the meter of the selected automatic playing pattern data.

15. A method of playing an electronic musical instrument with an automatic playing function, comprising the step of:

storing a plurality of automatic playing pattern data and a timing number corresponding to a meter for each of the automatic playing pattern data;

manipulating a tempo input device to register an interval of time between manipulations;

selecting automatic playing pattern data to be played;

calculating a tempo according to the interval of time between the manipulations of the tempo input device prior to starting the automatic playing function;

starting the automatic playing function when the tempo input device is manipulated for a number of times corresponding to the timing number for the automatic playing pattern data selected by the selection means;

reading out the selected automatic playing pattern data; and automatically playing according to the automatic playing pattern data at the calculated tempo.

16. A method according to claim 15, further comprising the step of selecting between a first mode to set the tempo manually or a second mode to set the tempo by the interval between the manipulations of the tempo input device.

17. A method according to claim 15, wherein each manipulation of the tempo input device corresponds to a beat, and wherein the automatic playing starts when one beat elapses after the tempo input device is manipulated for a number of times corresponding to the meter of the selected automatic playing pattern data.

18. A method according to claim 15, wherein the tempo is calculated based on the interval of time between the last two manipulations from among the manipulations of the tempo input device that correspond to the meter of the selected automatic playing pattern data.

* * * * *

UNITED STATES PATENT AND TRADEMARK OFFICE

CERTIFICATE OF CORRECTION

PATENT NO. : 5,382,750

DATED : January 17, 1995

INVENTOR(S) : MASAHIKO HASEBE ET AL

It is certified that error appears in the above-indentified patent and that said Letters Patent is hereby corrected as shown below:

On the title page, item [19], Masahiko should read --Hasebe--.

On the title page, item (75) Inventors:. the first inventors name "Hasebe Masahiko" is backwards. The correct name is --MASAHIKO HASEBE--.

Signed and Sealed this

Nineteenth Day of September, 1995

*Attest:*

*Attesting Officer*

Bruce Lehman

BRUCE LEHMAN

*Commissioner of Patents and Trademarks*